US005259967A

United States Patent [19]

Ripple

[11] Patent Number: 5,259,967

[45] Date of Patent: Nov. 9, 1993

[54] LOW ASH LUBRICANT COMPOSITION

[75] Inventor: David E. Ripple, Kirtland, Ohio

[73] Assignee: The Lubrizol Corporation, Wickliffe, Ohio

[21] Appl. No.: 900,214

[22] Filed: Jun. 17, 1992

[51] Int. Cl.[5] ..... C10M 159/12; C10M 163/00

[52] U.S. Cl. ..... 252/32.007 E; 252/51.005 A; 252/50; 252/18; 252/52 R

[58] Field of Search ..... 252/18, 51.5 A, 50, 252/32.7 E, 52, 56 R

[56] References Cited

U.S. PATENT DOCUMENTS

| | | | |
|---|---|---|---|
| 2,647,873 | 8/1953 | Matthews et al. | 252/42.7 |
| 2,807,653 | 9/1957 | Filbey et al. | 260/619 |
| 2,962,443 | 11/1960 | Rhodes | 252/56 |
| 3,384,587 | 5/1968 | Holst et al. | 252/33.4 |
| 3,853,774 | 12/1974 | Crocker | 252/33.4 |
| 3,973,201 | 2/1974 | Karn | 252/33.4 |
| 4,192,758 | 3/1988 | Dickey et al. | 252/33 |
| 4,686,054 | 8/1987 | Wisotsky et al. | 252/32.7 |
| 4,938,881 | 7/1990 | Ripple et al. | 252/32.7 |
| 5,024,775 | 6/1991 | Hanlon et al. | 252/52 |
| 5,102,566 | 4/1992 | Fetterman, Jr. et al. | 252/327 E |

*Primary Examiner*—Jacqueline V. Howard
*Attorney, Agent, or Firm*—David M. Shold

[57] ABSTRACT

A lubricating oil composition providing less than 1% sulfated ash comprises an additive package of a carboxylic dispersant, a rust inhibiting mixture, a hydrocarbyl substituted phenol prepared without sulfur or chlorine, and a neutralized acid or phenol.

44 Claims, No Drawings

LOW ASH LUBRICANT COMPOSITION

BACKGROUND OF THE INVENTION

The present invention relates to a lubricating oil composition and a concentrate therefor which provides low sulfated ash while meeting high performance standards.

There is continuous need for improving the performance characteristics of automotive gasoline and diesel engines and the lubricating oils used therein. For example, modern diesel engines are sometimes fitted with a particulate trap to minimize the amount of particulates which are emitted to the atmosphere as pollution. Such particulates may include soot from incomplete combustion but also include ash of various types, much of which is non-volatile metal compounds originating from metal-containing additives in the fuel or, especially, in the lubricant. Excessive ash buildup in particulate traps is a concern because certain types of metal-containing ash are not readily removed from the trap, thus making the regeneration and reuse of such traps difficult if not impossible.

Despite these drawbacks from the use of metal compounds in lubricants, additives, including metal-containing additives, have been used for many years and will likely continue to be used for many years in the future. This is because metal-containing additives perform essential functions in motor oils and other lubricants. Certain metal salts are detergents, which serve to neutralize acidic combustion products which make their way into motor oil. Others are dispersants or antiwear agents. To simply reduce or eliminate the amount of metal-containing additives from a motor oil would lead to failure of the oil in many industry-mandated performance tests.

There are industrial performance criteria which must be met for a variety of lubricant applications. Among the most important are those for diesel engines and those for gasoline engines. A useful lubricating oil will be able to pass the tests for both types of engines. Thus a reduced-ash lubricant which would pass the diesel engine performance tests but would fail gasoline engine tests would have only limited usefulness and would not be commercially acceptable as a universal engine lubricant.

There has been a great deal of research reported on various lubricant formulations to solve specific problems. For example, U.S. Pat. No. 4,938,881, Ripple et al., July 3, 1990, discloses lubricating oil compositions and concentrates which comprise a lubricating oil, the product of reacting a substituted succinic acylating agent with an amine, a basic alkali metal salt of sulfonic or carboxylic acid, a metal salt of a dihydrocarbyl dithiophosphoric acid, and optionally a neutral or basic alkaline earth metal salt of an acid organic compound.

U.S. Pat. No. 3,853,774, Crocker, Dec. 10, 1974, discloses oil-soluble basic magnesium salts. They may be used in oil formulations which contain alkenyl succinimide, carbonated sulfurized calcium polypropylene phenate, and zinc dithiophosphate.

U.S. Pat. No. 3,384,587, Holst et al., May 21, 1968, discloses a hyperbasic calcium sulfonate lubricating oil composition which also includes dispersants such as oxylated nonyl phenols of the formula $C_9H_{19}$—Ar—$(OCH_2CH_2)_nOH$ [Ar is a benzene ring] where n is an average integer of from 2 to 9.

U.S. Pat. No. 2,647,873, Matthews et al., Aug. 4, 1953, discloses a lubricating composition including a class of compounds which are suitable as additional agents. An example given is the product of para-octyl phenol, calcium hydroxide, and formaldehyde.

There has now been found a lubricating oil composition which is significantly reduced in ash-forming additives but which still meets demanding performance requirements for both gasoline and diesel engines.

SUMMARY OF THE INVENTION

The present invention provides a composition comprising:

(A) a major amount of an oil of lubricating viscosity;

(B) about 0.5 to about 5 percent by weight of a carboxylic dispersant component;

(C) a rust-inhibiting amount of a mixture comprising (C-1) a nonionic surfactant and (C-2) a hydrocarbyl-substituted carboxylic acid or derivative thereof;

(D) about 0.1 to about 10 percent by weight of at least one hydrocarbyl-substituted phenol;

provided that the hydrocarbyl-substituted phenol of (D) is prepared without the use of active sulfur- or chlorine-containing reactants, and further provided that the composition contains at least one material having acidic or phenolic functionality which has been reacted with a basic metal species such that the total sulfonated ash content of the composition is about 0.25 percent to less than 1 weight percent.

The invention further provides a concentrate comprising (A) a concentrate-forming amount of an organic solvent or diluent;

(B) about 0.5 to about 5 parts by weight of a carboxylic dispersant component;

(C) about 0.04 to about 2 parts by weight of a mixture comprising (C-1) a nonionic surfactant and (C-2) a hydrocarbyl-substituted carboxylic acid or derivative thereof;

(D) about 0.1 to about 10 parts by weight of at least one hydrocarbyl-substituted phenol;

provided that the at least one hydrocarbyl-substituted phenol of (D) is prepared without the use of active sulfuror chlorine-containing reactants.

DETAILED DESCRIPTION OF THE INVENTION

The present invention, in one embodiment, is a lubricating oil composition which comprises components as set forth below.

Component A of the present invention is an oil of lubricating viscosity, including natural or synthetic lubricating oils and mixtures thereof. Natural oils include animal oils, vegetable oils, mineral lubricating oils of paraffinic, napthenic, or mixed types, solvent or acid treated mineral oils, and oils derived from coal or shale. Synthetic lubricating oils include hydrocarbon oils, halo-substituted hydrocarbon oils, alkylene oxide polymers (including those made by polymerization of ethylene oxide or propylene oxide), esters of dicarboxylic acids and a variety of alcohols including polyols, esters of phosphorus-containing acids, polymeric tetrahydrofurans, and silcon-based oils (including siloxane oils and silicate oils). Included are unrefined, refined, and rerefined oils. Specific examples of the oils of lubricating viscosity are described in U.S. Pat. No. 4,326,972.

The of lubricating oil A in the invention will normally comprise the major amount of the composition. Thus it will normally be at least 50% by weight of the composition, preferably about 83 to about 98%, more preferably about 90 to about 94%, and most preferably about 92 to about 93%. As an alternative embodiment, however, the present invention can provide an additive concentrate in which the oil can be 0 to about 20% by weight, preferably about 1 to about 10%. The concentrate embodiment is described in more detail below.

Component B of the present invention is a carboxylic dispersant component. Such a dispersant normally comprises the reaction product of a hydrocarbyl-substituted succinic anhydride with at least one polyamine. It is understood that this reaction product need not be prepared from the anhydride itself, but can be prepared by the reaction of any suitable equivalent acylating agent. Such hydrocarbyl-substituted succinic acylating agents include succinic acids, halides, esters, and anhydrides, preferably, acids, esters or anhydrides, more preferably anhydrides. The hydrocarbyl substitutent group generally contains an average of at least about 8, or about 30, or about 35 up to about 350, or to about 200, or to about 100 carbon atoms. In one embodiment, the hydrocarbyl group is derived from a polyalkene characterized by an $\overline{M}n$ (number average molecular weight) of at least about 500. Generally, the polyalkene is characterized by an $\overline{M}n$ of about 500, or about 700, or about 800, or even about 900 up to about 5000, or to about 2500, or to about 2000, or even to about 1500.

The polyalkenes include homopolymers and interpolymers of polymerizable olefin monomers of 2 to about 16 or to about 6, or to about 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the interpolymer is a homopolymer, and preferably it is polyisobutylene. The preparation and use of substituted succinic acylating agents wherein the substituent is derived from such polyalkenes are described in U.S. Pat. No. 4,234,435.

In another embodiment, the succinic acylating agents are prepared by reacting the above described polyalkene with an excess of maleic anhydride to provide substituted succinic acylating agents wherein the number of succinic groups for each equivalent weight of substituent group is at least 1.3, or to about 1.5, or to about 1.7, or to about 1.8. The maximum number generally will not exceed 4.5, or to about 2.5, or to about 2.1, or to about 2.0. The polyalklene may be any of those described above. The preparation and use of substituted succinic acylating agents wherein the substituent is derived from such polyolefins are described in U.S. Pat. No. 4,234,435.

The succinic acylating agents are prepared by reacting the above-described hydrocarbyl substitutents with unsaturated carboxylic acylating agents, such as itaconic, citraconic, or maleic acylating agents at a temperature of about 160° or about 185° C. up to about 240° C., or to about 210° C. Maleic acylating agents are the preferred unsaturated acylating agent. The procedures for preparing the acylating agents are well known to those skilled in the art and have been described for example in U.S. Pat. No. 3,412,111.

The amine which reacts with the succinic acylating agent may be a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

Alkylene polyamines are represented by the formula

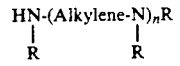

wherein n has an average value from 1, or about 2 to about 10, or to about 7, or to about 5, and the "Alkylene" group has from 1, or about 2 to about 10, or to about 6, or to about 4 carbon atoms. Each R is independently hydrogen, or an aliphatic or hydroxy-substituted aliphatic group of up to about 30 carbon atoms. Such alkylenepolyamines include methylenepolyamines, ethylenepolyamines, butylenepolyamines, propylenepolyamines, pentylenepolyamines, etc. Ethylenepolyamine, also referred to as polyethyleneamine, is preferred. Such polyamines are most conveniently prepared by the reaction of ethylene dichloride with ammonia or by reaction of an ethylene imine with a ring opening reagent such as water, ammonia, etc.

The reaction products of hydrocarbyl-substituted succinic acylating agents and amines and methods for preparing the same are described for example in U.S. Pat. Nos. 4,234,435; 4,952,328; 4,938,881; 4,957,649; and 4,904,401.

The preferred component (B) is the reaction product of polyisobutylene-substituted succinic anhydride with at least one polyethyleneamine.

The amount of component (B) in the composition is about 0.5 to about 5 weight percent, preferably 1 to about 4 weight percent.

Component C is a mixture of materials which is effective as an anti-rust agent. The first component of this mixture, C-1, is a non-ionic surfactant. Examples of nonionic surfactants include alkoxylated alcohols and phenols, such as propoxylated phenols, polyether esters of tall oils, and long chain amides such as oleylamide. A preferred non-ionic surfactant is an alkanol substituted by a polyether, i.e., by a chain of carbon and oxygen atoms. More preferably it is an alkylphenoxypoly(ethyleneoxy)-ethanol, and most preferably the alkyl group thereof is nonyl. A preferred material can be represented by the structure

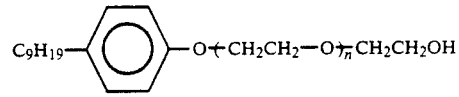

where n is about 2-4. Another suitable material is octylphenoxytetraethoxyethanol.

The preferred materials of Component C-1 can be prepared by ethyoxylation of alkylated phenols and are commercially available from GAF under the name Igepal TM CO430, and is also available under the name Surfonic TM N-40.

The second portion of the anti-rust mixture, component C-2, is a hydrocarbyl-substituted carboxylic acid (or preferably dicarboxylic acid) or derivative thereof. Suitable derivatives include half esters, anhydrides, amides, imides, imidazolines, oxazolines, and salts; preferably the material is present as the acid or a partial ester. Preferred acids include hydrocarbyl-substituted diacids such as succinic acid and homologues thereof. Such materials can be prepared by the routes outlined above for preparation of the hydrocarbyl-substituted succinic anhydrides of Component B, except that the product will be preferably converted to the acid (or optionally the half acid half ester) form. The alkyl substituent is preferably an oligomer of propylene, and is most preferably an oligomer (or a mixture of oligomers) which contains on the average about 4 propylne units. A highly preferred substituent is propylene tetramer. Such materials are available from Phillips Petroleum and Costal States Chemicals.

The total amount of component C in the composition is an amount suitable to provide a rust-inhibiting effect. Normally this amount will be about 0.04 to about 2 weight percent, and more preferably about 0.2 to about 1 weight percent. The relative amounts of components C-1 and C-2 will preferably be in the weight ratio of about 90:10 to about 10:90. The amount of component C-1 in the composition will preferably be about 0.1 to about 0.25 weight percent. The amount of Component C-2 in the composition will preferably be about 0.1 to about 0.3 weight percent.

Component D is at least one hydrocarbyl-substituted phenol, which is believed to serve as an antioxidant and which, it is believed, may in some cases further serve as a dispersant. Component D preferably comprises at least two substituted phenols. D-1 is a reaction product of a hydrocarbyl-substituted phenol and an aldehyde such as acetaldehyde or, preferably, formaldehyde. The reaction product is often a mixture of chemical species, generally involving two phenols bridged by an alkylene (preferably methylene) group ortho to the phenolic OH group. Depending on reaction conditions, however, three or even more aromatic rings can be linked by bridging methylene groups derived from formaldehyde. It is preferred that this phenolic component is at least partially neutralized by treatment with a basic metallic compound; preferably a calcium salt is formed by reaction of the bridged phenolic material with calcium oxide or hydroxide. Such materials are described in more detail in U.S. Pat. No. 3,793,201. Briefly, these reaction products include that class of phenols represented by the following general formula:

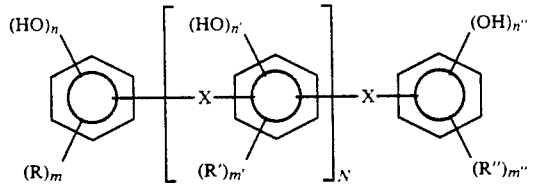

wherein n, n', and n'' are each independently integers of 1–3 but preferably 1; R, R', and R'' are each independently alipiphatic hydrocarbon groups such as alkyl or alkenyl of at least four carbon atoms each and usually six to forty carbon atoms each; m, m', and m'' are each independently integers of 0–3 but preferably 1 or 2; N is an integer of 0–10 but usually 0–5; and X is a divalent bridging radical. The divalent bridging radical usually will be a lower alkylene radical of up to about seven carbon atoms, and particularly methylene.

The preferred metal salts of bridged phenols are those selected from the class of neutral and basic metal salts of the condensation products of aliphatic hydrocarbon-substituted phenols and lower aliphatic aldehydes containing up to about seven carbon atoms. The aliphatic hydrocarbon substituents on the phenols used in preparing such condensation products should provide a total of at least four aliphatic carbon atoms per molecule of phenol and preferably, a total of at least six aliphatic carbon atoms per molecule. Each aliphatic hydrocarbon substituent may contain from about four to about 40 or more aliphatic carbon atoms but generally will contain from about six to about 30 aliphatic carbon atoms. The aliphatic aldehyde used in the formation of these phenolaldehyde condensation products is preferably formaldehyde or an equivalent material such as formalin or paraformaldehyde. Other suitable aldehydes include acetaldehyde, crotonaldehyde, butyaldehyde, propionaldehyde, and the like. Examples of the preparation of the metal salts of phenol-aldehyde condensation products is found in, for example, U.S. Pat. No. 2,647,873.

The preferred hydrocarbyl substituent of component D-1 is an alkyl substituent, which is preferably an oligomer of propylene and most preferably an oligomer (or a mixture of oligomers) which contains on the average about 4 propylene units.

In order for the proper functioning of the present invention, it is important that the material of component D-1 have been prepared without the use of active sulfur- or chlorine-containing reagents, in part because of the deleterious effects that sulfur or chlorine contaminants have on the corrosion properties of lubricating oils. Furthermore, such materials, if they are bridged with sulfur atoms rather than alkylene groups, are believed to perform less efficiently, even if there is no contamination by residual elemental sulfur. Thus the materials of component D-1 are not bridged with sulfur atoms, in contrast to the situation with many more common bridged phenols. Rather, they are bridged with the alkylene or preferably methylene groups resulting from reaction of the phenol with the aldehyde, preferably the formaldehyde.

A second and optional component of the mixture of D is Component D-2, a phenol substituted in the ortho or 2,6 positions by t-butyl groups and in the para or 4 position by a hydrocarbyl group, preferably an alkyl group. Such materials are commercially available and can be prepared, if desired, by the reaction of di-t-butyl phenols with an appropriate alkanol in the presence of KOH and alkanal at elevated temperature. Such a synthesis is described in U.S. Pat. No. 5,024,775. As with component D-1, component D2 may be at least partially neutralized with a metal ion, but as with component D-1, it is important that this substituted phenol be prepared without the use of S or Cl containing reagents.

The alkyl substituent for component D-2 is preferably an oligomer of propylene, and is most preferably an oligomer (or a mixture of oligomers) which contains on the average about 4 propylene units. The alkyl substitutent can be attached to the phenol by customary alkylation techniques; the material can be further alkylated at the 2,6 positions using isobutylene and customary techniques. The materials of component D-2 are well-known and commercially availalble.

The total amount of component D in the composition is about 0.1 to about 10 weight percent. Although component D-2 is an optional component, it is preferred that D-1 and D-2 be present in relative weight ratios of about 95:5 to about 5:95. The amount of Component D-1 in the composition is preferably about 0.2 to about 1% by weight; the amount of component D-2 is preferably about 1 to about 2% by weight. While it is preferred that component D-2 is present, it can be reduced or entirely eliminated, particularly if there is a corresponding increase in the amount of components D-1 and E (described below) so as to attain equivalent performance characteristics.

Although it is believed that the aforementioned components are those which are required for the present invention, the composition should also include at least one material having acidic or phenolic functionality which has been reacted with at least a stoichiometric equivalent, and preferably a stoichiometric excess of a basic metal species. This may be a separate component, as described below for component E, or it may represent a neutralization or overbasing of one or more of the phenolic components D-1 or D-2. Overbasing, also referred to as superbasing or hyperbasing, is a means for supplying a large quantity of basic material in a form which is soluble or dispersable in oil. Overbased products have been long used in lubricant technology to provide detergent additives.

Overbased materials are single phase, homogeneous systems characterized by a metal content in excess of that which would be present according to the stoichiometry of the metal and the particular acidic organic compound reacted with the metal. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention have a metal ratio of about 1.5, more preferably about 3, more preferably about 7, up to about 40, preferably about 25, more preferably about 20.

The overbased materials (A) are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter.

The acidic organic compounds useful in making the overbased compositions of the present invention include carboxylic acids, sulfonic acids, phosphorus-containing acids, phenols or mixtures of two or more thereof. (Any reference to acids, such as carboxylic, or sulfonic acids, is intended to include the acid-producing derivatives thereof such as anhydrides, lower alkyl esters, acyl halides, lactones and mixtures thereof unless otherwise specifically stated.)

The carboxylic acids useful in making the overbased salts of the invention may be aliphatic or aromatic, mono- or polycarboxylic acid or acid-producing compounds. These carboxylic acids include lower molecular weight carboxylic acids (e.g., carboxylic acids having up to about 22 carbon atoms such as acids having about 4 to about 22 carbon atoms or tetrapropenyl-substituted succinic anhydride) as well as higher molecular weight carboxylic acids.

The carboxylic acids of this invention are preferably oil-soluble. Usually, in order to provide the desired oil-solubility, the number of carbon atoms in the carboxylic acid should be at least about 8, more preferably at least about 18, more preferably at least about 30, more preferably at least about 50. Generally, these carboxylic acids do not contain more than about 400 carbon atoms per molecule.

The lower molecular weight monocarboxylic acids contemplated for use in this invention include saturated and unsaturated acids. Examples of such useful acids include dodecanoic acid, decanoic acid, tall oil acid, 10-methyl-tetradecanoic acid, 3-ethyl-hexadecanoic acid, and 8-methyl-octadecanoic acid, palmitic acid, stearic acid, myristic acid, oleic acid, linoleic acid, behenic acid, hexatriacontanoic acid, tetrapropylenyl-substituted glutaric acid, polybutenyl-substituted succinic acid derived from a polybutene (Mn =200–1500), polypropenyl-substituted succinic acid derived from a polypropene, (Mn =200–1000), octadecyl-substituted adipic acid, chlorostearic acid, 9-methylstearic acid, dichlorostearic acid, stearyl-benzoic acid, eicosanyl-substituted naphthoic acid, dilauryl-decahydronaphthalene carboxylic acid, mixtures of any of these acids, their alkali and alkaline earth metal salts, and/or their anhydrides, etc. A preferred group of aliphatic carboxylic acids includes the saturated and unsaturated higher fatty acids containing from about 12 to about 30 carbon atoms. Other acids include aromatic carboxylic acids include substituted and non-substituted benzoic, phthalic and salicylic acids or anhydrides, most especially those substituted with a hydrocarbyl group containing about 6 to about 80 carbon atoms. Examples of suitable substituent groups include butyl, isobutyl, pentyl, octyl, nonyl, dodecyl, and substituents derived from the above-described polyalkenes such as polyethylenes, polypropylenes, polyisobutylenes, ethylene-propylene copolymers, oxidized ethylene-propylene copolymers, and the like.

Sulfonic acids are also useful in making the overbased salts of the invention and include the sulfonic and thiosulfonic acids. The sulfonic acids include the mono- or polynuclear aromatic or cycloaliphatic compounds. The oil-soluble sulfonates can be represented for the most part by one of the following formulae: $R_2$—T—$(SO_3)_a$ and $R_3$—$(SO_3)_b$, wherein T is a cyclic nucleus such as, for example, benzene, naphthalene, anthracene, diphenylene oxide, diphenylene sulfide, petroleum naphthenes, etc.; $R_2$ is an aliphatic group such as alkyl, alkenyl, alkoxy, alkoxyalkyl, etc.; $(R_2)+T$ contains a total of at least about 15 carbon atoms; and $R_3$ is an aliphatic hydrocarbyl group containing at least about 15 carbon atoms. Examples of $R_3$ are alkyl, alkenyl, alkoxyalkyl, carboalkoxyalkyl, etc. Specific examples of $R_3$ are groups derived from petrolatum, saturated and unsaturated paraffin wax, and the above-described polyalkenes. The groups T, $R_2$, and $R_3$ in the above Formulae can also contain other inorganic or organic substituents in addition to those enumerated above such as, for example, hydroxy, mercapto, halogen, nitro, amino, nitroso, sulfide, disulfide, etc. In the above Formulae, a and b are at least 1.

Illustrative examples of these sulfonic acids include monoeicosanyl-substituted naphthalene sulfonic acids, dodecylbenzene sulfonic acids, didodecylbenzene sulfonic acids, dinonylbenzene sulfonic acids, cetylchlorobenzene sulfonic acids, dilauryl beta-naphthalene sulfonic acids, the sulfonic acid derived by the treatment of polybutene having a number average molecular weight (Mn) in the range of 500 to 5000 with chlorosulfonic acid, nitronaphthalene sulfonic acid, paraffin wax sulfonic acid, cetyl-cyclopentane sulfonic acid, lauryl-cyclohexane sulfonic acids, polyethylenyl-substituted sulfonic acids derived from polyethylene (Mn=300–1000), etc. Normally the aliphatic groups will be alkyl and/or alkenyl groups such that the total number of aliphatic carbons is at least about 8.

Another group of sulfonic acids are mono-, di-, and tri-alkylated benzene and naphthalene (including hydrogenated forms thereof) sulfonic acids. Such acids include di-isododecyl-benzene sulfonic acid, polybutenyl-substituted sulfonic acid, polypropylenyl-substituted sulfonic acids derived from polypropene having an Mn=300-1000, cetylchlorobenzene sulfonic acid, di-cetylnaphthalene sulfonic acid, di-lauryldiphenylether sulfonic acid, diisononylbenzene sulfonic acid, di-isooctadecylbenzene sulfonic acid, stearylnaphthalene sulfonic acid, and the like.

Specific examples of oil-soluble sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax-substituted sulfonic and polysulfonic acids of, e.g., benzene, naphthalene, phenol, diphenyl ether, naphthalene disulfide, etc.; other substituted sulfonic acids such as alkyl benzene sulfonic acids (where the alkyl group has at least 8 carbons), cetylphenol mono-sulfide sulfonic acids, dilauryl beta naphthyl sulfonic acids, and alkaryl sulfonic acids such as dodecyl benzene "bottoms" sulfonic acids (the material leftover after the removal of dodecyl benzene sulfonic acids that are used for household detergents). The production of sulfonates from detergent manufactured by-products by reaction with, e.g., $SO_3$, is well known to those skilled in the art.

Phosphorus-containing acids are also useful in making the basic metal salts of the present invention and include any phosphorus acids such as phosphoric acid or esters; and thiophosphorus acids or esters, including mono and dithiophosphorus acids or esters. Preferably, the phosphorus acids or esters contain at least one, preferably two, hydrocarbyl groups containing from 1 to about 50 carbon atoms. The phosphorus-containing acids useful in the present invention are described in U.S. Pat. No. 3,232,883 issued to Le Suer.

The phenols useful in making the basic metal salts of the invention can be those described above for components D-1 and D-2, but are more generally represented by the formula $(R_1)_8$—Ar—$(OH)_b$, wherein $R_1$ is a hydrocarbyl group as defined above; Ar is an aromatic group; a and b are independently numbers of at least one, the sum of a and b being in the range of two up to the number of displaceable hydrogens on the aromatic nucleus or nuclei of Ar. $R_1$ and a are preferably such that there is an average of at least about 8 aliphatic carbon atoms provided by the $R_1$ groups for each phenol compound. The aromatic group as represented by "Ar" can be mononuclear such as a phenyl, a pyridyl, or a thienyl, or polynuclear.

The metal compounds useful in making the basic metal salts are generally any Group I or Group II metal compounds (CAS version of the Periodic Table of the Elements). The Group I metals of the metal compound include alkali metals (sodium, potassium, lithium, etc.) as well as Group IB metals such as copper. The Group I metals are preferably sodium, potassium, lithium and copper, more preferably sodium or potassium, and more preferably sodium. The Group II metals of the metal base include the alkaline earth metals (magnesium, calcium, barium, etc.) as well as the Group IIB metals such as zinc or cadmium. Preferably the Group II metals are magnesium, calcium, or zinc, preferably magnesium or calcium, more preferably magnesium. Generally the metal compounds are delivered as metal salts. The anionic portion of the salt can be hydroxyl, oxide, carbonate, borate, nitrate, etc.

An acidic material is used to accomplish the formation of the basic metal salt. The acidic material may be a liquid such as formic acid, acetic acid, nitric acid, sulfuric acid, etc. Acetic acid is particularly useful. Inorganic acidic materials may also be used such as HCl, $SO_2$, $SO_3$, $CO_2$, $H_2S$, etc, preferably $CO_2$. A preferred combination of acidic materials is carbon dioxide and acetic acid.

A promoter is a chemical employed to facilitate the incorporation of metal into the basic metal compositions. Among the chemicals useful as promoters are water, ammonium hydroxide, organic acids of up to about 8 carbon atoms, nitric acid, sulfuric acid, hydrochloric acid, metal complexing agents such as alkyl salicylaldoxime, and alkali metal hydroxides such as lithium hydroxide, sodium hydroxide and potassium hydroxide, and mono- and polyhydric alcohols of up to about 30 carbon atoms. Examples of the alcohols include methanol, ethanol, isopropanol, dodecanol, behenyl alcohol, ethylene glycol, monomethylether of ethylene glycol, hexamethylene glycol, glycerol, pentaerythritol, benzyl alcohol, phenylethyl alcohol, aminoethanol, cinnamyl alcohol, allyl alcohol, and the like. Especially useful are the monohydric alcohols having up to about 10 carbon atoms and mixtures of methanol with higher monohydric alcohols.

Patents specifically describing techniques for making basic salts of the above-described sulfonic acids, carboxylic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

The amount of the overbased acidic or phenolic material present in the composition should be such that the total sulfated ash content of the composition is about 0.25 percent to less than 1 weight percent, preferably less than about 0.7 weight percent, and most preferably about 0.5 weight percent or less. Sulfated ash is a well-defined term, known to those skilled in the art and described in detail in ASTM D-874-82. Sulfated ash is a measurement which corresponds to the sum of all the metals which are present in the lubricating composition. The limited amount of sulfated ash in the present invention directly corresponds to a limited amount of total metals, which limits can be readily calculated by one skilled in the art, with reference to the examples contained herein.

Commercial lubricating oils customarily contain more than one source of metal. For instance, they may contain neutral and overbased metal salts of organic acids or phenols, which may function as dispersants or antioxidants. They may also contain salts, particularly zinc salts, of alkyl phosphorodithioic acids, described below. The requirement of the present invention that the sulfated ash be under 1%, and preferably well under 1%, requires that the total contribution from all the metals be maintained at these levels. For example, a customary lubricant composition may contains 1% sulfated ash, which represents the sum of 0.2% zinc ash from a zinc alkyl phosphorodithioate and 0.8% calcium or magnesium ash from overbased acids. A reduction of this ash level to the preferred level of about 0.5% might be accomplished by the halving of both the zinc and the calcium or magnesium levels. However, it may well be desirable that the amount of zinc alkyl phosphordithioate remain unchanged, in order to retain the functional benefits of this material as an additive. In that case the amount of calcium or magnesium overbased acids would need to be reduced from the original level corresponding to 0.8% ash to the dramatically lower level corresponding to 0.3% ash. It is unexpected that such a significant reduction could still provide a lubricant which gives protection to machinery and engines, but this is what has been found when the compositions of the present invention are employed.

It is preferred that the required metal content of the present compositions be provided at least in part by means of added overbased salts of organic acids, which have been described in detail above. These particular materials are referred to hereafter as component E.

Component E is at least one overbased alkali or alkaline earth metal salt of an organic acid. It is preferred that Component E be a mixture of at least two materials, designated herein E-1 and E-2. Component E-1 is preferably a neutral or slightly overbased calcium salt of an organic sulfonic acid. Neutral salts are salts in which the organic sulfonic acid is reacted with an equivalent amount of base, in this case, calcium base. Overbased materials have been described in detail above.

The overbased materials of component E-1 are prepared by reacting an acidic material (typically an inorganic acid or lower carboxylic acid, preferably carbon dioxide) with a mixture comprising preferably an organic sulfonic acid, a reaction medium comprising at least one inert, organic solvent (mineral oil, naphtha, toluene, xylene, etc.) for said acidic organic material, a stoichiometric excess of a metal base, preferably a calcium metal base, and a promoter, as described above. In the present invention it is preferred that the sulfonic acid which comprises Component E-1 is petroleum sulfonic acid, which is a commercially available mixture of sulfonated alkylates available, e.g., from Witco.

It is also preferred that a second material also be present in Component E. Component E-2 is preferably an overbased magnesium salt of an organic sulfonic acid. Overbased salts have been described in detail above. However, here the neutralizing salt is preferably magnesium, rather than calcium, and the extent of overbasing is considerably greater. Thus for component E-2 the neutralization is from about 1000 to about 2000 percent, that is, a metal ratio of about 10 to about 20. Preferably the extent of neutralization is about 1300 to about 1700 percent, and the acid is, as before, petroleum sulfonic acid.

The total amount of component E in the composition is that amount which, in combination with the other metal-containing components of the composition, provides the required level of sulfate ash. In particular, the amount of such salts should preferably be about 0.05 to about 4 percent by weight, depending, of course, on the extent of neutralization and metal content. The amount of component E-1 is preferably about 0.2 to about 0.8 weight percent, and more preferably about 0.3 to about 0.7 percent. The amount of component E-2 is preferably about 0.07 to about 0.6 weight percent, and more preferably about 0.1 to about 0.4 percent.

Commercially useful lubricants commonly contain a zinc salt of a dialkyl phosphoroditioic acid, which is believed to serve primarily as an antiwear agent. Accordingly, the present invention preferably contains such a salt, designated as Component F. This zinc salt will also contribute to the total % ash of the composition, as described above.

The phosphorodithioic acids from which the metal salts useful in this invention are prepared can be obtained by the reaction of about 4 moles of an alcohol mixture per mole of phosphorus pentasulfide, and the reaction may be carried out within a temperature range of from about 50° to about 200° C. The reaction generally is completed in about 1 to 10 hours, and hydrogen sulfide is liberated during the reaction.

The alcohol mixtures which are utilized in the preparation of the dithiophosphoric acids useful in this invention include mixtures of isopropyl alcohol, secondary butyl alcohol, and at least one primary aliphatic alcohol containing from about 3 to 13 carbon atoms. In particular, the alcohol mixture can contain at least 10 mole percent of isopropyl and/or secondary butyl alcohol and will generally comprise from about 20 mole percent to about 90 mole percent of isopropyl alcohol. In one preferred embodiment, the alcohol mixture will comprise from about 40 to about 60 mole percent of isopropyl alcohol, the remainder being one or more primary aliphatic alcohols.

The primary alcohols which may be included in the alcohol mixture include n-butyl alcohol, isobutyl alcohol, n-amyl alcohol, isoamyl alcohol, n-hexy alcohol, 2-ethyl-1-hexyl alcohol, isoootyl alcohol, nonyl alcohol, deoyl alcohol, dodecyl alcohol, tridecyl alcohol, etc. The primary alcohols also may contain various substituent groups such as halogens. Particular examples of useful mixtures of alcohols include, for example, isopropyl/n-butyl; isopropyl/secondary butyl; isopropyl/2-ethyl-1-hexy; isopropyl/isooctyl; isopropyl/decyl; isopropyl/dodecyl; and isopropyl/tridecyl. In one preferred embodiment, the primary alcohols contain 6 to about 13 carbon atoms, and the total number of carbon atoms per phosphorus atom is at least 9.

Most preferably the alkyl groups of the alkyl phosphorodithioic acid are isooctyl or isopropyl groups, or a mixture thereof.

The preparation of the metal salt of the dithiophosphoric acids may be effected by reaction with the metal or metal oxide. Simply mixing and heating these two reactants is sufficient to cause the reaction to take place and the resulting product is sufficiently pure for the purposes of this invention. Typically the formation of the salt is carried out in the presence of a diluent such as an alcohol, water or diluent oil. Neutral salts are prepared by reacting one equivalent of metal oxide or hydroxide with one equivalent of the acid. Basic metal salts are prepared by adding an excess of (more than one equivalent) the metal oxide or hydroxide with one equivalent of phosphorodithioic acid.

The amount of Component F in the composition is about 0.7 to about 1.3 percent by weight, preferably about 0.8 to about 1.2 parts by weight.

Lubricating compositions will normally also contain a variety of other conventional additives, and as such the present composition will preferably also contain the following optional components.

Component G is a hydrocarbyl substituted diphenylamine, which is believed to function as an antioxidant. Preferably it is a diphenylamine which is mono- or disubstituted in the para positions with alkyl groups. The alkyl groups preferably have an average of about 8 to about 12 (and most preferably on average about 9) carbon atoms. The materials of Component G are prepared by alkylation of diphenylamine by known processes and are commercially available from Uniroyal Chemical under the names Naugard TM 4386 or OIU-38 TM.

The amount of Component G in the composition is up to about 0.7 weight percent, preferably at least about 0.08 weight percent, and more preferably about 0.17 to about 0.34 percent. Normally component G will be present in the composition, but its amount can be reduced or even eliminated, particularly if there is a corresponding increase in the amount of other components which may have antioxidant properties, such as components D or E.

Component H is an antifoam agent, preferably a silicone antifoam agent. Examples of antifoam agents include polysiloxanes, and preferably dimethylpolysiloxanes. These materials are commercially available from Dow Corning and are known as Dow Corning TM Fluids.

The amount of Component H in the composition is the amount required to reduce foaming when the composition is used as a lubricant. This amount is normally about 0.001 to about 0.1 percent by weight, preferably about 0.005 to about 0.02 parts by weight.

In a preferred compositions the total amount of all the above components B-H in the final formulated composition is about 6 to about 10% by weight, more preferably about 7.5 to about 8% by weight. It is noted that components B through H are sometimes provided as a solution or dispersion in lubricating oil or other inert material, and the presence Of such material should be taken into consideration when calculating the amount of the active component.

Furthermore, other customary components may be added to the lubricating composition. in their customary amounts, provided, however, that the total sulfated ash of the composition remains less than about 1 percent. Examples of such other components include antioxidants, friction modifiers, corrision inhibitors such as tolytriazoles, pour point depressants, and viscosity index modifiers.

The present invention includes not only a fully formulated lubricating composition, which has been described in detail above, but also a concentrate. In a concentrate the amount of lubricating oil is significantly reduced, or it can even be replaced by another inert vehicle, i.e., a suitable diluent or solvent for the remaining components. The amounts of the remaining components would then be correspondingly larger so that when the concentrate is diluted for use with oil of lubricating viscosity the concentration of each component will be within an acceptable range. Similarly the amount of metals, expressed as sulfated ash, in such a concentrate will be correspondingly greater, most likely greater than 1%, but it will still be less than in other concentrates and will be such that when the concentrate is properly diluted the sulfated ash will be less than 1%.

The relative amounts of components in the concentrate will generally be about the same as they are in the fully formulated lubricating oil. It is convenient under these circumstances to express the relative amounts as parts by weight, rather than as percentage, since the total of such parts need not equal 100. Thus for a concentrate the amount of carboxylic dispersant (B) is normally about 0.5 to about 5 parts, for the rust-inhibiting component (C) the amount is normally about 0.04 to about 2 parts, and for the hydrocarbyl-substituted phenol (D) the amount is normally about 0.5 to about 10 parts. Preferred amounts can be readily determined by reference to the above discussion.

Each of the components mentioned herein can be a mixture of related compounds each of which falls within the scope as defined or a mixture of compounds selected such that the overall composition on average falls within the defined scope.

As used herein, the term "hydrocarbyl substituent" or "hydrocarbyl group" means a group having a carbon atom directly attached to the remainder of the molecule and having predominantly hydrocarbon character. Such groups include hydrocarbon groups, substituted hydrocarbon groups, and hetero groups, that is, groups which, while primarily hydrocarbon in character, contain atoms other than carbon present in a chain or ring otherwise composed of carbon atoms.

EXAMPLES

Concentrate compositions are prepared by blending together the components indicated in Table I (amounts are parts by weight).

TABLE I

| Component | Description | Ex 1 | Ex 2 | Ex 3 |
|---|---|---|---|---|
| A | Diluent Oil | 0.75 | 0.42 | 0.35 |
| B | High molecular weight (ca. 2000) iso-butylene-substituted succinic anhydride reaction product with polyethyleneamine having a CO:N ratio of about 1:1, 45% by weight in oil. | 5.5 | 5.5 | |
| | Similar material having a CO:N ratio of about 6:5, 47% by weight in oil. | | | 5.5 |
| C-1 | nonylphenoxypoly(ethyleneoxy) ethanol (m.w. about 418–440) | 0.15 | 0.15 | 0.15 |
| C-2 | propylene tetramer substituted succinic acid, 61% by weight in oil | 0.35 | 0.35 | 0.35 |
| D-1 | condensation product prepared from propylene tetramer substituted phenol, formaldehyde, and lime (ca. ½ equivalent based on phenol), 55% by weight in oil | 0.85 | 0.85 | 0.85 |
| D-2 | p-propylene tetramer substituted 2,4-di-t-butylphenol | 1.6 | 1.6 | 1.6 |
| E-1 | petroleum sulfonate (m.w. ca. 350–600) overbased with calcium carbonate, metal ratio 1.2, 50% by weight in oil | 1.0 | 1.0 | 1.0 |
| E-2 | petroleum sulfonate as above, overbased with magnesium carbonate, metal ratio 14.7, 68% by weight in oil | 0.4 | 0.4 | 0.4 |
| F | zinc salt of mixed isooctyl- & isopropylphosphorodithioic acid, 88% by weight in oil | 1.3 | 1.1 | 1.3 |
| G | C9 mono- & di-para substituted diphenylamine, 84% by weight in oil | 0.3 | 0.4 | 0.3 |
| H | silicone antifoaming agent (from Dow, with kerosene diluent) | 0 | 0 | 0.008 |
| Other tolyltriazole | | — | 0.03 | — |
| Total parts, weight | | 12.2 | 11.8 | 11.8 |
| Calcium content, % | | 0.37 | 0.39 | 0.36 |
| Magnesium content, % | | 0.31 | 0.32 | 0.32 |
| Zinc content, % | | 1.02 | 0.88 | 1.05 |

The concentrates of Examples 1–3 are added to mineral oil of lubricating viscosity (15W-40) as shown in Table II. The fully formulated oil is tested for sulfated ash, and the results are shown in Table II.

TABLE II

| | Example: | | |
|---|---|---|---|
| | 4 | 5 | 6 |
| Concentrate from Example: | 1 | 2 | 3 |
| Amount concentrate (wt. %) | 12.2 | 11.8 | 11.8 |
| Sulfated ash, % | 0.52 | 0.49 | 0.53 |

Each of the lubricating oils of Examples 4–6 are subjected to tests for diesel and gasoline-powered engines and exhibit good performance in terms of high temperature deposit formation, high temperature oxidation, low and high temperature sludge and varnish formation, low and high temperature wear, engine rust formation, and copper-lead bearing corrosion.

Each of the documents referred to above is incorporated herein by reference. As used herein, the expression "consisting essentially of" permits the inclusion of small amounts of substances which do not materially affect the basic and novel characteristics of the composition under consideration.

What is claimed is:

1. A composition comprising:

(A) a major amount of an oil of lubricating viscosity;

(B) about 0.5 to about 5 percent by weight of a carboxylic dispersant component;

(C) a rust-inhibiting amount of a mixture comprising (C-1) a nonionic surfactant and (C-2) a hydrocarbyl-substituted carboxylic acid or derivative thereof;

(D) about 0.1 to about 10 percent by weight of at least one hydrocarbyl-substituted phenol;

provided that the hydrocarbyl-substituted phenol of (D) is prepared without the use of active sulfur- or chlorine-containing reactants, and further provided that the composition contains at least one material having acidic or phenolic functionality which has been reacted with a basic metal species such that the total sulfated ash content of the composition is about 0.25 percent to less than 1 weight percent.

2. The composition of claim 1 wherein the dispersant component (B) is a reaction product of a hydrocarbyl-substituted succinic acid-producing compound with at least one polyamine.

3. The composition of claim 2 wherein the reaction product of B is the reaction product of polyisobutylene-substituted succinic anhydride with at least one polyethyleneamine.

4. The composition of claim 1 wherein the amount of B is about 1 to about 4 weight percent.

5. The composition of claim 1 wherein the amount of component C is about 0.04 to about 2 weight percent.

6. The composition of claim 5 wherein the amount of component C is about 0.2 to about 1 weight percent.

7. The composition of claim 1 wherein components C-1 and C-2 are present in relative amounts of about 90:10 to about 10:90.

8. The composition of claim 1 wherein the amount of component C-1 is about 0.1 to about 0.25 weight percent and the amount of component C-2 is about 0.1 to about 0.3 weight percent.

9. The composition of claim 1 wherein component C-1 is an alkanol substituted by a polyether.

10. The composition of claim 9 wherein component C-1 is nonylphenoxypoly(ethyleneoxy)ethanol.

11. The composition of claim 1 wherein component C-2 is an alkyl-substituted succinic acid.

12. The composition of claim 11 wherein the alkyl group of component C-2 is a propylene tetramer.

13. The composition of claim 1 wherein component C-2 is a partial ester of an alkyl-substituted succinic acid.

14. The composition of claim 1 wherein the ester is the condensate of about 0.2 to about 0.5 moles of an alkylene oxide per mole of alkyl-substituted succinic acid.

15. The composition of claim 1 wherein component D comprises a mixture of (D-1) a reaction product of hydro-carbyl-substituted phenol and an aldehyde and (D-2) a 2,6-di-t-butyl phenol substituted in the 4 position with an alkyl group.

16. The composition of claim 15 wherein D-1 is the reaction product of an alkyl-substituted phenol and formaldehyde, at least partially neutralized with a basic metallic compound.

17. The composition of claim 16 wherein the alkyl group is a propylene oligomer.

18. The composition of claim 17 wherein the propylene oligomer contains on average about 4 propylene units.

19. The composition of claim 16 wherein the metallic compound is a basic calcium compound.

20. The composition of claim 15 wherein the alkyl group of D-2 is a propylene oligomer.

21. The composition of claim 20 wherein the propylene oligomer contains on average about 4 propylene units.

22. The composition of claim 1 wherein the amount of component D is about 1 to about 4 weight percent.

23. The composition of claim 15 wherein components D-1 and D-2 are present in the relative amounts of about 95:5 to about 5:95.

24. The composition of claim 23 wherein the amount of component D-1 is about 0.2 to about i weight percent and the amount of component D-2 is about 1 to about 2 weight percent.

25. The composition of claim 1 further comprising (E) at least one overbased alkali or alkaline earth metal salt of an organic acid.

26. The composition of claim 25 wherein the at least one salt comprises (E-1) about 0.2 to about 0.8 percent by weight of a neutral or overbased calcium salt of organic sulfonic acid, neutralized from about 100 to about 150 percent and (E-2) about 0.07 to about 0.6 percent by weight of an overbased magnesium salt of organic sulfonic acid, neutralized from about 1000 to about 2000 percent.

27. The composition of claim 26 wherein the organic sulfonic acid of E-1 is petroleum sulfonic acid which is overbased about 110 to about 130 percent with carbonate anion.

28. The composition of claim 27 wherein the amount of E-1 is about 0.3 to about 0.7 percent by weight.

29. The composition of claim 26 wherein the organic sulfonic acid of E-2 is petroleum sulfonic acid which is overbased about 1300 to about 1700 percent with carbonate anion.

30. The composition of claim 29 wherein the amount of E-2 is about 0.1 to about 0.4 percent by weight.

31. The composition of claim 1 further comprising (F) about 0.7 to about 1.3 percent by weight of a zinc salt of an alkyl phosphorodithioic acid.

32. The composition of claim 31 wherein the alkyl group in (F) is isooctyl or isopropyl or a mixture thereof.

33. The composition of claim 31 wherein the amount of component F is about 0.8 to about 1.2 percent by weight.

34. The composition of claim 1 further comprising (G) about 0.08 to about 0.7 weight percent of a hydrocarbyl-substituted diphenylamine.

35. The composition of claim 34 wherein the diphenylamine of G is mono- or di-para-substituted with alkyl groups having an average of about 8 to about 12 carbon atoms.

36. The composition of claim 34 wherein the amount of G is about 0.17 to about 0.34 weight percent.

37. The composition of claim 1 further comprising (H) about 0.001 to about 0.1 weight percent of an antifoam agent.

38. The composition of claim 37 wherein the antifoam agent is a silicone antifoam agent.

39. The composition of claim 1 wherein the amount of basic metal which is reacted with the material having acidic or phenolic functionality is selected such that the total sulfated ash of the composition is less than about 0.7 percent.

40. The composition of claim 39 where the total sulfated ash is no greater than about 0.5%.

41. A concentrate comprising (A) a concentrate-forming amount of an organic diluent or solvent;

(B) about 0.5 to about 5 parts by weight of a carboxylic dispersant component;

(C) about 0.04 to about 2 parts by weight of a mixture comprising (C-1) a nonionic surfactant and (C-2) a hydro-carbyl-substituted carboxylic acid or derivative thereof;

(D) about 0.1 to about 10 parts by weight of at least one hydrocarbyl-substituted phenol;

provided that the hydrocarbyl-substituted phenol of (D) is prepared without the use of active sulfur- or chlorine-containing reactants.

42. The concentrate of claim 41 wherein component B is a reaction product of a hydrocarbyl-substituted succinic anhydride with at least one polyamine.

43. The concentrate of claim 41 wherein component C-1 is an alkanol substituted by a polyether, wherein component C-2 is an alkyl-substituted succinic acid, and wherein components C-1 and C-2 are present in relative amounts of about 90:10 to about 10:90 by weight.

44. The concentrate of claim 41 wherein the organic solvent or diluent is an oil of lubricating viscosity.

* * * * *